US008397495B2

(12) United States Patent
Salanta et al.

(10) Patent No.: US 8,397,495 B2
(45) Date of Patent: Mar. 19, 2013

(54) EXHAUST GAS ADDITIVE/TREATMENT SYSTEM AND MIXER FOR USE THEREIN

(75) Inventors: Gabriel Salanta, Ann Arbor, MI (US); Guanyu Zheng, Farmington, MI (US); Daniel Salanta, Ann Arbor, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 1273 days.

(21) Appl. No.: 12/215,271

(22) Filed: Jun. 26, 2008

(65) Prior Publication Data

US 2009/0320453 A1 Dec. 31, 2009

(51) Int. Cl.
*F01N 13/08* (2010.01)
*B01F 5/00* (2006.01)

(52) U.S. Cl. ..... 60/324; 60/317; 123/306; 366/336

(58) Field of Classification Search ..... 366/174.1, 366/336, 337, 338, 339; 138/42; 60/282, 60/317, 324; 123/306, 592, 568.11–568.19
See application file for complete search history.

(56) References Cited

U.S. PATENT DOCUMENTS

| | | | | | |
|---|---|---|---|---|---|
| 3,190,618 | A * | 6/1965 | Katzen | 366/337 |
| 3,652,061 | A * | 3/1972 | Chisholm | 366/337 |
| 3,751,009 | A * | 8/1973 | Archer | 366/337 |
| 3,923,288 | A * | 12/1975 | King | 366/336 |
| 4,019,719 | A * | 4/1977 | Schuster et al. | 366/338 |
| 4,034,965 | A * | 7/1977 | King | 366/336 |
| 4,072,296 | A * | 2/1978 | Doom | 366/337 |
| 4,179,222 | A * | 12/1979 | Strom et al. | 366/337 |
| 4,208,136 | A * | 6/1980 | King | 366/338 |
| 4,220,416 | A * | 9/1980 | Brauner et al. | 366/337 |
| 4,255,124 | A * | 3/1981 | Baranowski, Jr. | 431/353 |
| 4,296,779 | A * | 10/1981 | Smick | 138/38 |
| 4,753,535 | A * | 6/1988 | King | 366/337 |
| 5,146,910 | A * | 9/1992 | Grahl et al. | 126/110 R |
| 5,215,375 | A * | 6/1993 | Ditzler et al. | 366/337 |
| 5,378,063 | A * | 1/1995 | Tsukada | 366/337 |
| 5,484,203 | A * | 1/1996 | King et al. | 366/337 |
| 5,492,408 | A * | 2/1996 | Alfare | 366/337 |
| 5,522,661 | A * | 6/1996 | Tsukada | 366/337 |
| 5,605,399 | A * | 2/1997 | King | 366/337 |
| 5,813,762 | A * | 9/1998 | Fleischli et al. | 366/337 |
| 5,851,067 | A * | 12/1998 | Fleischli et al. | 366/337 |
| 5,916,134 | A | 6/1999 | Yang et al. | |
| 6,676,286 | B2 * | 1/2004 | Grutter et al. | 366/337 |
| 6,745,562 | B2 | 6/2004 | Berriman et al. | |
| 6,796,296 | B2 | 9/2004 | Kim | |
| 7,104,251 | B2 | 9/2006 | Kim | |
| 7,137,731 | B2 * | 11/2006 | Carlson | 366/337 |
| 7,390,121 | B2 * | 6/2008 | Jahn et al. | 366/337 |
| 7,753,080 | B2 * | 7/2010 | Liu et al. | 138/39 |
| 8,043,394 | B2 | 10/2011 | Mital et al. | |
| 2005/0219947 | A1 * | 10/2005 | Carlson | 366/337 |
| 2006/0245296 | A1 * | 11/2006 | Nishioka et al. | 366/174.1 |

* cited by examiner

OTHER PUBLICATIONS

International Search Report and Written Opinion dated Nov. 2, 2009, 7 pages.

* cited by examiner

*Primary Examiner* — Tony G Soohoo
(74) *Attorney, Agent, or Firm* — Wood, Phillips, Katz, Clark & Mortimer

(57) ABSTRACT

An exhaust mixer (16) is provided for use in an engine exhaust system (10) downstream from an additive injector (14). The mixer (16) includes eight vanes (20), with four of the vanes (20A) extending from a first side (22) of the mixer (16) and arranged in an equally spaced circumferential array around a central axis (24), and the other four of the vanes (20B) extending from an opposite side (26) of the mixer (16) and arranged opposite from the other four vanes (20A) in an equally spaced circumferential array.

30 Claims, 9 Drawing Sheets

EXHAUST GAS ADDITIVE/TREATMENT SYSTEM AND MIXER FOR USE THEREIN

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

BACKGROUND OF THE INVENTION

This invention relates to systems or devices that treat an exhaust gas or other gas stream by introducing one or more additives into the gas stream and for mixers used in such systems to mix the additive with the exhaust gas, often upstream of a catalyst.

It is known to treat exhaust gases or other gas streams by introducing one or more additives into the exhaust gas in order to enhance or create a catalytic reaction in a device downstream from the injection for the purpose of reducing undesirable emissions. In one known system, a reducing agent is injected into the exhaust gas of a diesel engine in order to reduce the amount of nitrogen oxides ($NO_x$) in the exhaust gas via catalytic reduction. In such systems, it is known for the additive to be provided in the form of ammonia or urea (dissolved in water) prior to the catalytic reaction. When this is done, it is important to obtain adequate mixing of the exhaust gas with the additive/reducing agent.

SUMMARY OF THE INVENTION

In accordance with one feature of the invention, an exhaust mixer is provided for use in an engine exhaust system downstream from an additive injector. The mixer includes a pair of interlocked blade structures, with each of the blade structures including a first pair of vanes extending from a first side of the blade structure and a second pair of vanes extending from an opposite side of the blade structure.

As one feature, each of the vanes of each pair of vanes extends from the corresponding blade structure at a mixing angle that is congruent with the mixing angle of the other vane of the pair.

In one feature, the mixing angles of each pair of vanes are in opposite directions.

According to one feature, each of the blade structures is a unitary part that is interlocked with the other blade structure.

As one feature, the blade structures are identical to each other and are interlocked in opposite orientations.

According to one feature, each of the blade structures further includes a spine with the first and second pairs of vanes extending from the spine.

In one feature, each of the spines lies in a plane parallel to a central axis of the mixer.

As one feature, each of the spine includes a notch sized to receive the spine of the other blade.

According to one feature, each of the spines is perforated.

As one feature, mount flanges extend from opposite ends of each of the spines.

In one feature, the blades are arranged normal to each other.

According to one feature, the vanes are all of the same size and shape.

As one feature, at least one the vanes is bifurcated to form at least two end baffles extending from the vane.

In one feature, the at least two end baffles each have an orientation relative to the mixer that is different from the orientation of the other of the at least two end baffles.

According to one feature, the at least two end baffles each have a size and shape that differs from the size and shape of the other of the at least two end baffles.

In accordance with one feature of the invention, an exhaust mixer is provided for use in an engine exhaust system downstream from an additive injector. The mixer includes eight vanes, with four of the vanes extending from a first side of the mixer and arranged in an equally spaced circumferential array around a central axis, and the other four of the vanes extending from an opposite side of the mixer and arranged opposite from the other four vanes in an equally spaced circumferential array.

As one feature, each of the vanes extends from the mixer at a mixing angle that is congruent with the mixing angle of the other vanes.

According to one feature, the mixing angles of the vanes on the first side are in an opposite directions from the mixing angle of the vanes on the opposite side of the mixer.

In one feature, two of the vanes on the first side and two of the vanes on the second side extend from a spine.

As one feature, the spine lies in a plane parallel to a central axis of the mixer.

In one feature, each of the spines is perforated.

According to one feature, mount flanges extend from opposite ends of the spine.

As one feature, at least one the vanes is bifurcated to define at least two end baffles extending from the vane.

In one feature, the at least two end baffles each have an orientation relative to the mixer that is different from the orientation of the other of the at least two end baffles.

According to one feature, the at least two end baffles each have a size and shape that differs from the size and shape of the other of the at least two end baffles.

Other objects, features, and advantages of the invention will become apparent from a review of the entire specification, including the appended claims and drawings.

DETAILED DESCRIPTION OF THE PREFERRED EMBODIMENT

Figure 1:
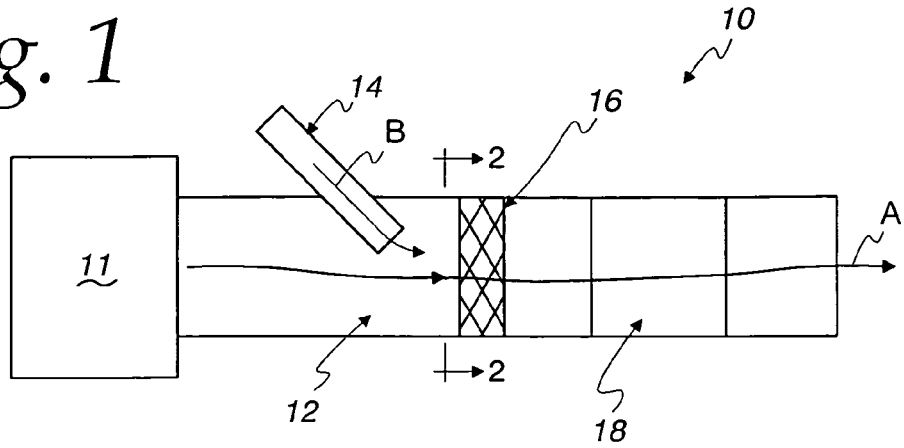
FIG. 1 is a diagrammatic representation of a system for treating an exhaust gas by introducing an additive into the exhaust gas upstream from a catalyst.
Figure 2:
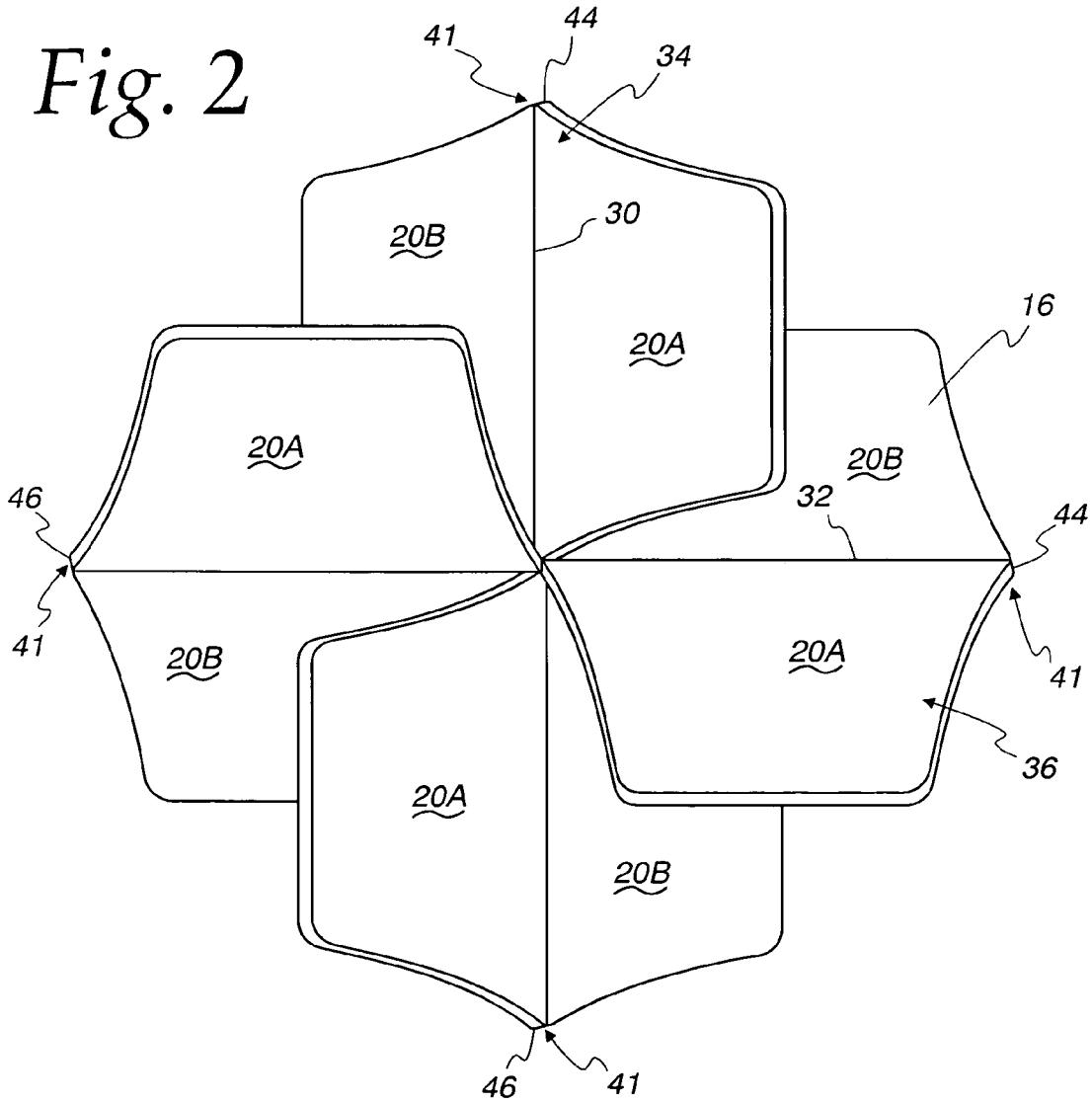
FIG. 2 is a view of an exhaust gas/additive mixer of FIG. 1 taken along lines 2-2 in FIG. 1.

With reference to FIG. 1, a system 10 is shown for treating an exhaust gas stream shown schematically by arrow A, from an engine or other exhaust gas producing device 11. The system 10 includes a flow path 12, one or more additive injectors 14, a mixer 16, and an after treatment element or zone in the form of an selective catalytic reduction (SCR) catalyst 18. The flow path 12 may be provided in any suitable form, and typically will be provided in the form of an exhaust duct or pipe and/or a housing for the catalyst 18, and may be combined or integrated with other exhaust gas treatment structures, such as, for example, a muffler or particulate filter. The additive injector(s) 14 may also be of any suitable form, many which are known, and in the illustrated embodiment preferably injects a reagent solution (typically a urea solution), shown schematically by arrow B, into a diesel exhaust gas stream A upstream of the mixer 16 and the catalyst 18.

Figure 3:
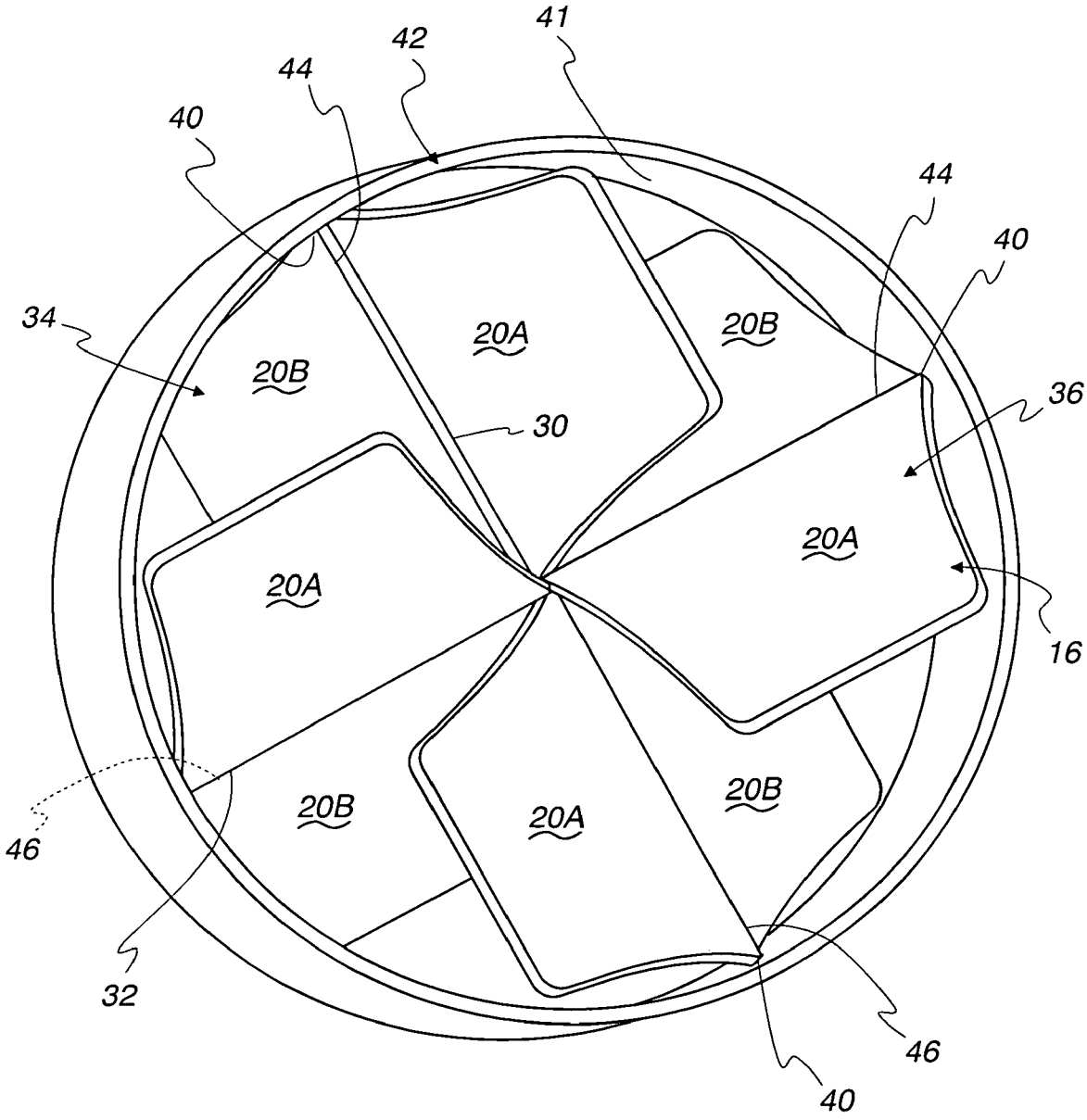
FIG. 3 is a perspective view of the mixer of FIG. 2 installed in a portion of an exhaust pipe of the system of FIG. 1.
Figure 4:
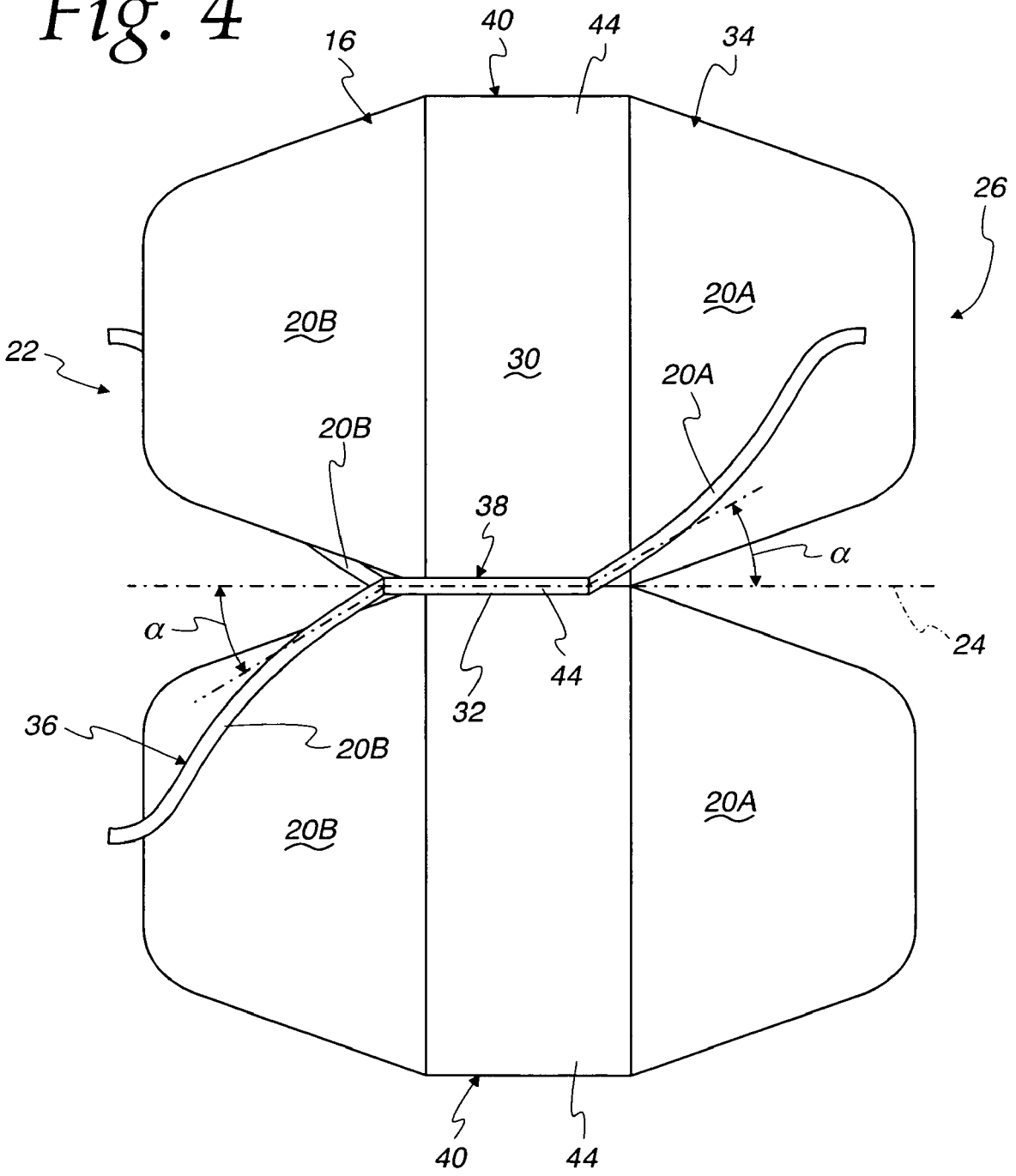
FIG. 4 is a side view of the component of FIG. 2 taken from line 4-4 in FIG. 2.

With reference to FIGS. 2-6, the mixer 16 includes eight vanes 20, with four of the vanes 20A extending from a first side 22 of the mixer 16 and arranged in an equally spaced circumferential array around a central axis 24, and the other four of the vanes 20B extending from an opposite side 26 of the mixer 16 and arranged opposite from the vanes 20A in an equally spaced circumferential array. As best seen in FIG. 4, preferably, each of the vanes 20 extends from the mixer 16 at a mixing angle $\alpha$ and curvature that is congruent with the mixing angle $\alpha$ and curvature of the other vanes 20, with the mixing angles $\alpha$ of the vanes 20A being in the opposite direction from the mixing angles $\alpha$ of the vanes 20B. It is also preferred that each of the vanes 20 be of the same size and shape as the other vanes 20.

Again with reference to FIG. 4, in the illustrated embodiment, two of the vanes 20A and the two vanes 20B arranged opposite therefrom extend from a central spine 30, with the other two of the vanes 20A and the other two of the vanes 20B arranged opposite therefrom extending from a central spine 32. Preferably, each of the spines 30 and 32 is planer and lies in a plane that is parallel to the axis 24.

Figure 5:
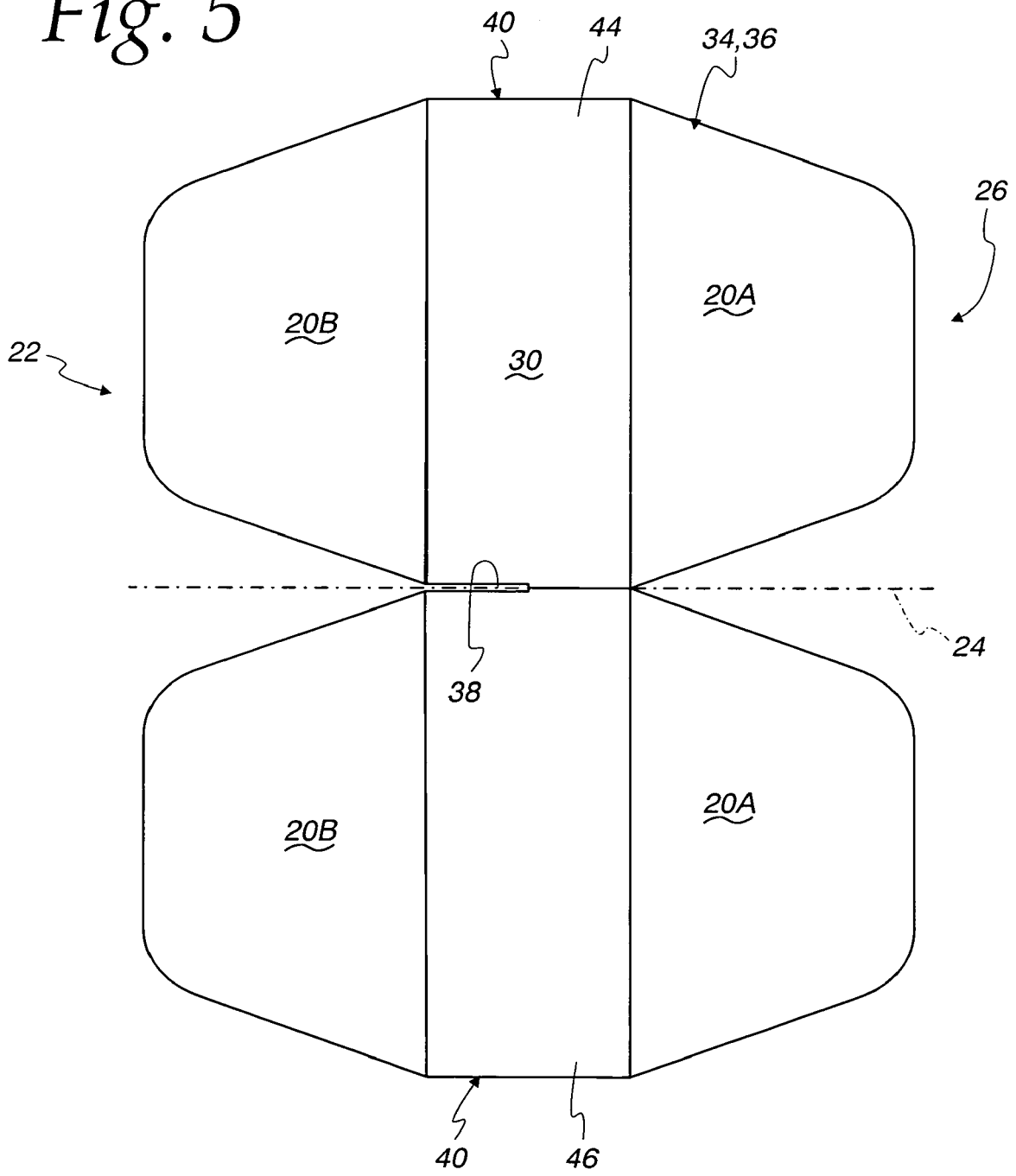
FIG. 5 is a view similar to FIG. 4, but with one component of he mixer removed.
Figure 6:
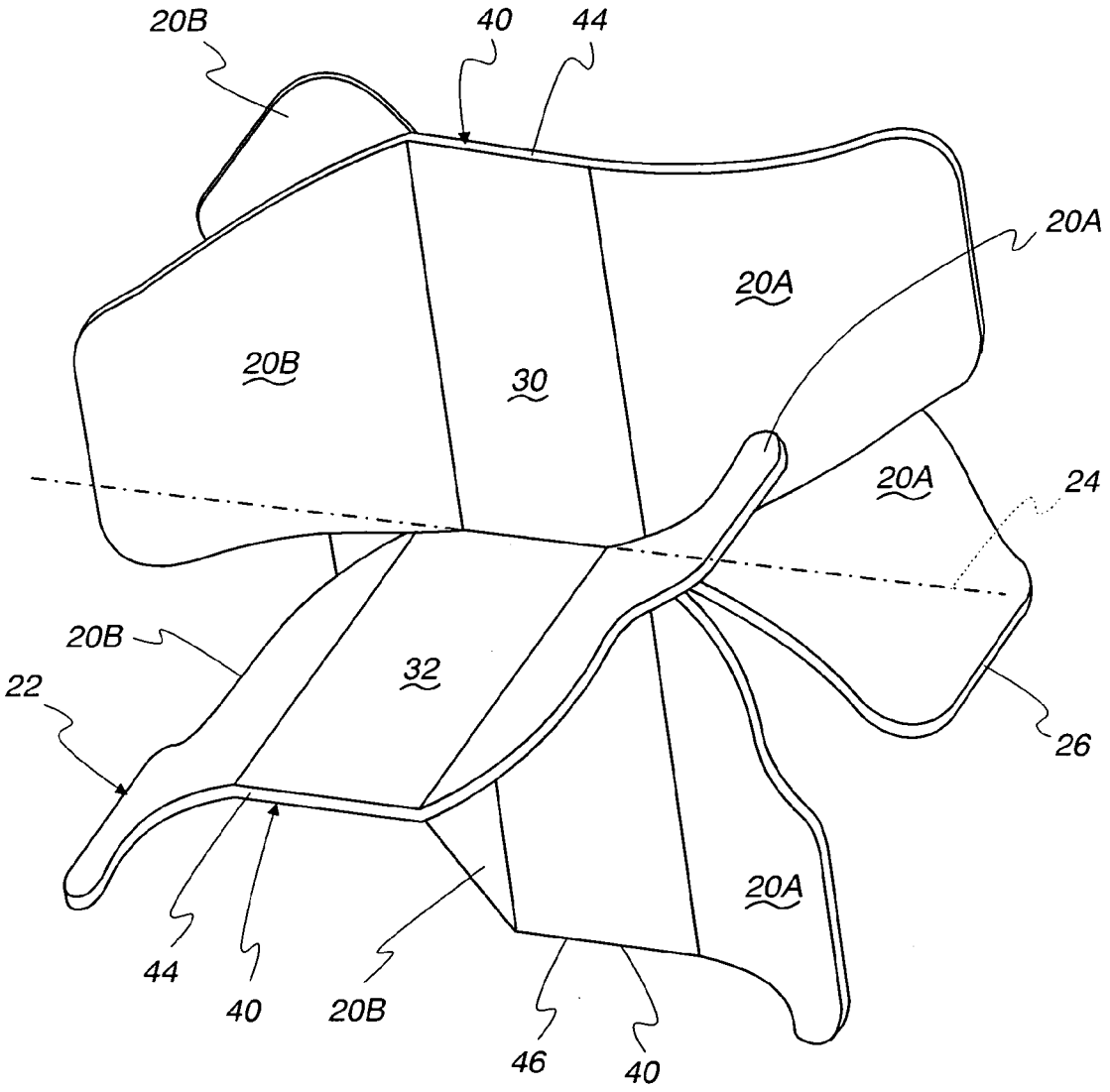
FIG. 6 is another perspective view of the mixer of FIG. 2.
Figure 7:
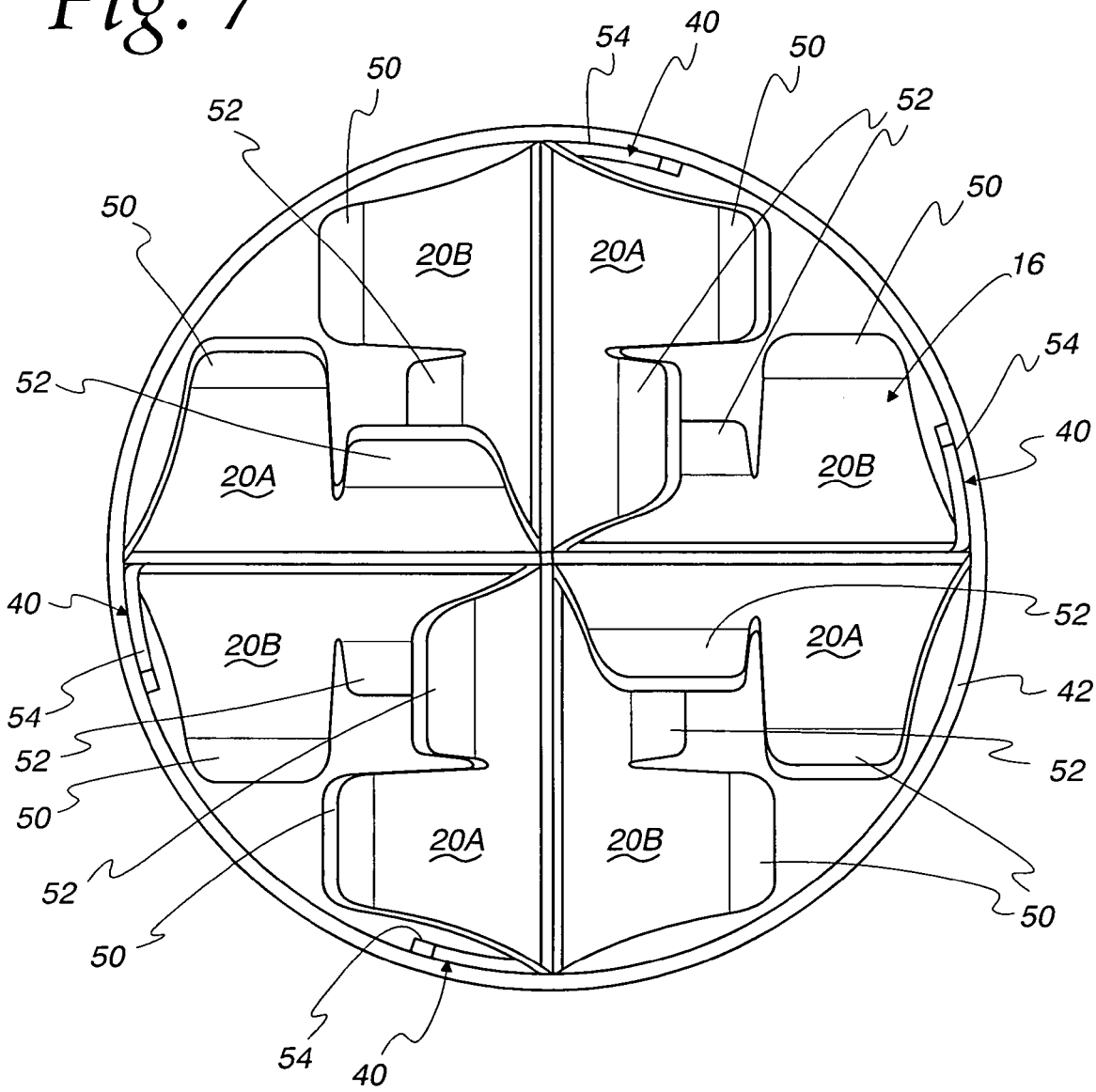
FIG. 7 is view similar to FIG. 2 but showing an alternate embodiment of a mixer installed in a portion of an exhaust pipe of the system of FIG. 1.
Figure 8:
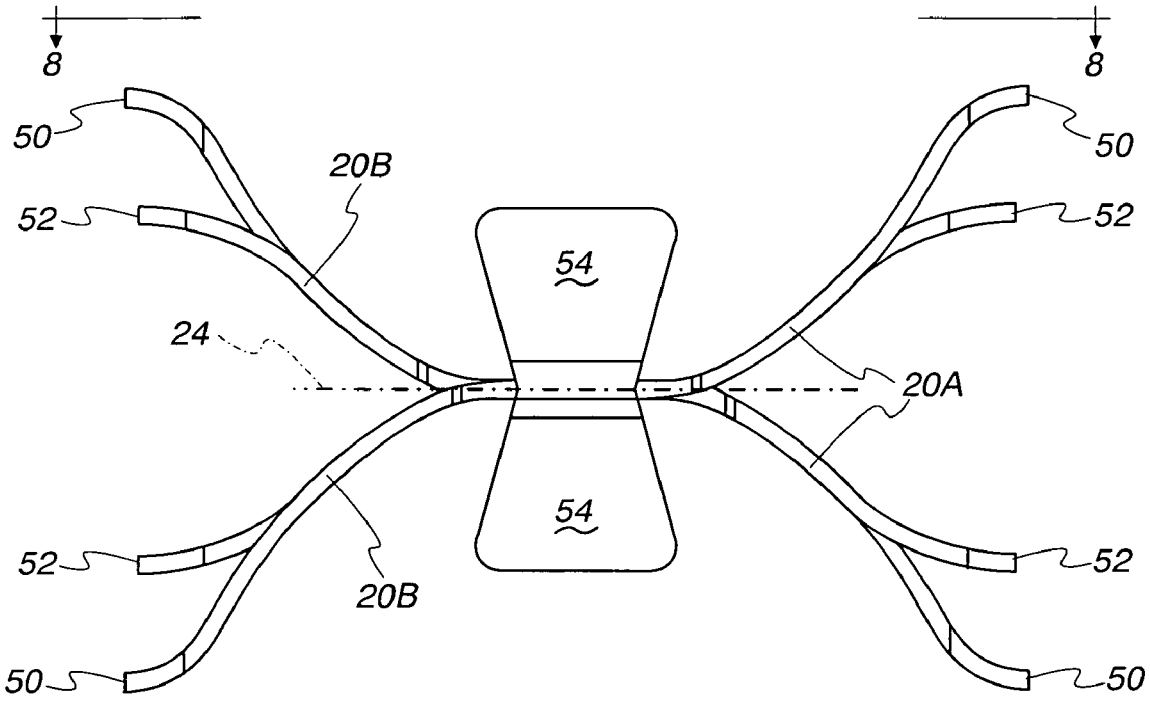
FIG. 8 is a top view of the mixer component of FIG. 7, but with one component of the mixer removed.

While any suitable construction can be used, as best seen in FIG. 5, the mixer 16 is preferably constructed from a pair of interlocked blade structures 34 and 36 (only one shown in FIG. 5), with each of the blade structures including either the vanes 20A and 20B that extend from the spine 30, or the vanes 20A and 20B that extend from the spine 32. In this regard, each of the spines 30 and 32 includes a slot or notch 38 that is sized to receive the spine 30, 32 of the other blade 34, 36. It can be seen that with the preferred embodiments described to this point, the blades 34 and 36 are identical to each other and can be defined as a single piece part. In this regard, while the blades 34 and 36 can be manufactured by any suitable means, it is preferred that the blades 34 and 36 be fabricated from a stamped piece of sheet metal that is suitable for the temperature, stresses, gases, and other parameters of each application. The advantages of having a single piece part and the ability for that part to be manufactured as a stamping will be evident to those skilled in the art.

With reference to FIG. 3, it can be seen that the mixer 16 is preferably sized so that its radially outermost surfaces 40 engage an inner surface 41 of the exhaust housing or pipe 42 in which the mixer 16 is mounted. As best seen in FIGS. 4 and 5, the surfaces 40 are defined by the opposite ends 44 and 46 of each of the spines 30 and 32. Preferably, the surfaces 40 are bonded to the inner surface 41 such as by brazing or welding. Depending upon which direction the sides 22 and 26 are facing when the mixer 16 is mounted in the exhaust housing or pipe 42, either the blades 20A or the blades 20B will be on an upstream side of the mixer 16 with respect to the direction of exhaust gas flow and the other of the vanes 20A and 20B will be on the downstream side of the mixer 16 with respect to the direction of the exhaust gas flow.

With reference to the alternate embodiment of the mixer 16 shown in FIGS. 7-10, it can be seen that the end of each of the vanes 20 has been bifurcated to define at least two end baffles 50 and 52, with each of the end baffles 50 and 52 preferably having an orientation relative to the mixer that is different from the orientation of the other of the baffles 38 and 40 for each vane 20A and 20B. Specifically, each of the baffles 50 has a mixing angle and/or curvature that is/are different from the mixing angle and/or curvature of the baffles 52. As with the embodiment of FIGS. 2-6, it is preferred that the mixing angle $\alpha$ and curvature of each of the vanes 20 be congruent to the mixing angle $\alpha$ and curvature of the other vanes 20, and that the vanes 20 all have the same size and shape.

Figure 9:
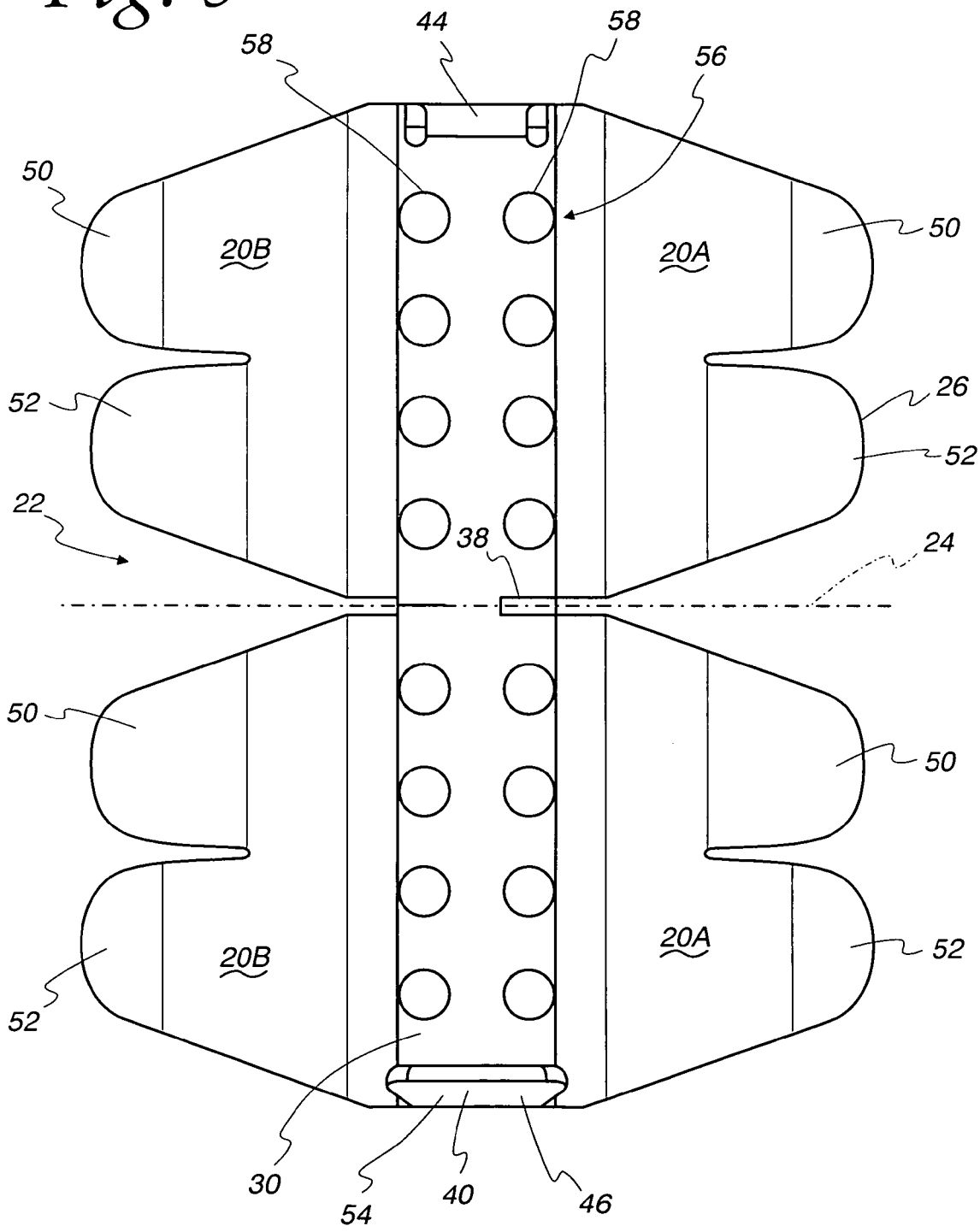
FIG. 9 is a view taken from line 8-8 in FIG. 8.
Figure 10:
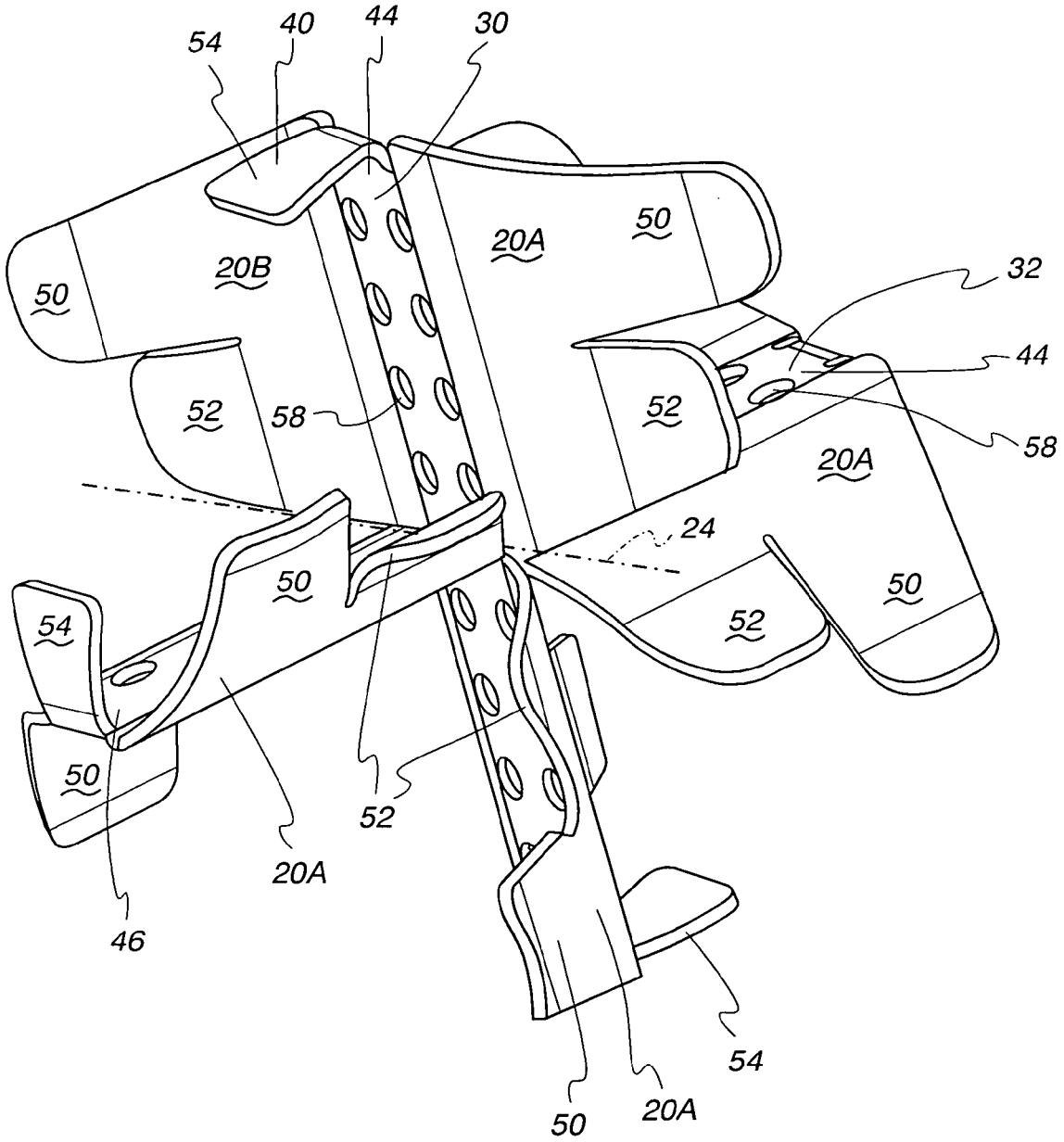
FIG. 10 is a perspective view of the mixer of FIG. 7.

As another feature, it can be seen that the radially outermost surfaces 40 of the embodiment of FIGS. 7-10 are defined by circumferentially extending mount flanges 54 that extend from the ends 44 and 46 of each of the spines 30 and 32. Preferably, the flanges 54 are bonded to the inner surface 41 of the exhaust housing or pipe 42 such as by brazing or welding. As yet another feature, each of the spines 30 and 32 is perforated with an array 56 of circular openings 58 (16 in the illustrated embodiment), as best seen in FIGS. 9 and 10, which are intended to enhance mixing of the additive(s) and the exhaust gas.

For both of the illustrated embodiments, testing has shown that the vanes 20A and 20B swirl the combined gas/additive flow to provide enhanced mixing and superior reduction efficiency from the system 10 in comparison to more conventional mixers.

It should be understood that while preferred embodiments of the mixer 16 have been shown herein, there are many possible modifications that may be desirable depending upon the particular brand of each application. For example, while the vanes 20A and 20B are all of the same size and shape for the mixer embodiment 16 shown in FIGS. 3-6, and for the mixer embodiment shown in FIGS. 7-10, in some applications it may be desirable for selected ones, or all of the vanes 20 to be of a different size and shape with respect to other vanes 20 in the mixer 16. Similarly, while the baffles 50 and 52 on each of the vanes 20 in the embodiment of FIGS. 7-10 are of a different size and shape relative to each other, in some applications, it may be desirable for the baffles 50 and 52 to be of the same size and shape. Furthermore, while the mixing angles $\alpha$ and curvature are congruent for all of the vanes 20 in the illustrated embodiments, in some applications it may be desirable for the mixing angles $\alpha$ and/or curvature to vary for one or more of the vanes 20 in comparison to the mixing angle $\alpha$ and/or curvature of the other vanes 20. As yet another example, while the spines 30 and 32 of the embodiment of FIGS. 2-6 are shown as imperforate, it may be desirable in some applications for the spines 30 and 32 to include the openings 58. In this regard, while the openings 58 are shown as circular and are arranged in a specific array, other shapes, sizes, numbers and arrays may be desirable depending upon the specific parameters of each application. By way of further example, while each vane 20 has been shown in FIGS. 7-10 with two baffles 50 and 52, it may be desirable in some applications for each of the vanes 20 to include more than two baffles. Furthermore, while the baffles 50 have been illustrated as having a different mixing angle and curvature from the baffles 52, it may be desirable for the mixing angles and/or curvatures of the baffles 50 and 52 to be congruent.

The invention claimed is:

1. An exhaust mixer for use in an engine exhaust system downstream from an additive injector, the mixer comprising:

a pair of interlocked blade structures, each of the blade structures comprising a first pair of vanes extending from a first side of the blade structure and a second pair of vanes extending from an opposite side of the blade structure;

wherein each of the blade structures further comprises a spine with the first and second pairs of vanes extending from the spine; and wherein each of the spines is perforated.

2. The exhaust mixer of 1 wherein each of the vanes of each pair of vanes extends from the corresponding blade structure at a mixing angle that is congruent with the mixing angle of the other vane of the pair.

3. The exhaust mixer of claim 2 wherein the mixing angles of each pair of vanes are in opposite directions.

4. The exhaust mixer of claim 1 wherein each of the blade structures is a unitary part that is interlocked with the other blade structure.

5. The exhaust mixer of claim 4 wherein the blade structures are identical to each other and are interlocked in opposite orientations.

6. The exhaust mixer of claim 1 wherein each of the spines lies in a plane parallel to a central axis of the mixer.

7. The exhaust mixer of claim 1 wherein each of the spines includes a notch sized to receive the spine of the other blade structure.

8. An exhaust mixer for use in an engine exhaust system downstream from an additive injector, the mixer comprising:

a pair of interlocked blade structures, each of the blade structures comprising a first pair of vanes extending from a first side of the blade structure and a second pair of vanes extending from an opposite side of the blade structure:

wherein each of the blade structures further comprises a spine with the first and second pairs of vanes extending from the spine: and wherein mount flanges extend from opposite ends of each of the spines.

9. The exhaust mixer of claim 1 wherein the blade structures are arranged normal to each other.

10. The exhaust mixer of claim 1 wherein the vanes are all of the same size and shape.

11. The exhaust mixer of claim 8 wherein each of the vanes of each pair of vanes extends from the corresponding blade structure at a mixing angle that is congruent with the mixing angle of the other vane of the pair.

12. The exhaust mixer of claim 11 wherein the mixing angles of each pair of vanes are in opposite directions.

13. The exhaust mixer of claim 8 wherein each of the blade structures is a unitary part that is interlocked with the other blade structure.

14. The exhaust mixer of claim 13 wherein the blade structures are identical to each other and are interlocked in opposite orientations.

15. The exhaust mixer of claim 8 wherein each of the spines lies in a plane parallel to a central axis of the mixer.

16. The exhaust mixer of claim 8 wherein each of the spines includes a notch sized to receive the spine of the other blade structure.

17. The exhaust mixer of claim 8 wherein the blade structures are arranged normal to each other.

18. The exhaust mixer of claim 8 wherein the vanes are all of the same size and shape.

19. An exhaust mixer for use in an engine exhaust system downstream from an additive injector, the mixer comprising:

a pair of interlocked blade structures, each of the blade structures comprising a first pair of vanes extending from a first side of the blade structure and a second pair of vanes extending from an opposite side of the blade structure; and wherein at least one the vanes is bifurcated to define at least two end baffles extending from the vane.

20. The exhaust mixer of claim 19 wherein the at least two end baffles each have an orientation relative to the mixer that is different from the orientation of the other of the at least two end baffles.

21. The exhaust mixer of claim 19 wherein the at least two end baffles each have a size and shape that differs from the size and shape of the other of the at least two end baffles.

22. An exhaust mixer for use in an engine exhaust system downstream from an additive injector, the mixer comprising;

eight vanes, four of the vanes extending from a first side of the mixer and arranged in an equally spaced circumferential array around a central axis, the other four of the vanes extending from an opposite side of the mixer and arranged opposite from the other four vanes in an equally spaced circumferential array;

wherein two of the vanes on the first side and two of the vanes on the second side extend from a planar spine.

23. The exhaust mixer of claim 22 wherein each of the vanes extends from the mixer at a mixing angle that is congruent with the mixing angle of the other vanes.

24. The exhaust mixer of claim 23 wherein the mixing angles of the vanes on the first side are in an opposite directions from the mixing angle of the vanes on the opposite side of the mixer.

25. The exhaust mixer of claim 22 wherein the planar spine lies in a plane parallel to a central axis of the mixer.

26. The exhaust mixer of claim 22 wherein the planar spine is perforated.

27. The exhaust mixer of claim 22 wherein at least one the vanes is bifurcated to define at least two end baffles extending from the vane.

28. The exhaust mixer of claim 27 wherein the at least two end baffles each have an orientation relative to the mixer that is different from the orientation of the other of the at least two end baffles.

29. The exhaust mixer of claim 27 wherein the at least two end baffles each have a size and shape that differs from the size and shape of the other of the at least two end baffles.

30. An exhaust mixer for use in an engine exhaust system downstream from an additive injector, the mixer comprising:

eight vanes, four of the vanes extending from a first side of the mixer and arranged in an equally spaced circumferential array around a central axis, the other four of the vanes extending from an opposite side of the mixer and arranged opposite from the other four vanes in an equally spaced circumferential array;

wherein two of the vanes on the first side and two of the vanes on the second side extend from a planar spine; and wherein mount flanges extend from opposite ends of the planar spine.

* * * * *